United States Patent [19]

Steyvers et al.

[11] 4,212,182

[45] Jul. 15, 1980

[54] INDIRECT METAL EXTRUSION AND TUBE PRESS AND A SEALING PLATE AND A PRESSURE PLATE THEREFOR

[75] Inventors: Weinfried Steyvers, Dusselford-Oberkassel; Franz-Josef Zilges, Monchengladbach, both of Fed. Rep. of Germany

[73] Assignee: Schloemann-Siemag Aktiengesellschaft, Dusseldorf, Fed. Rep. of Germany

[21] Appl. No.: 937,770

[22] Filed: Aug. 29, 1978

[30] Foreign Application Priority Data

Sep. 5, 1977 [DE] Fed. Rep. of Germany ..... 2739904

[51] Int. Cl.[2] ..... B21C 26/00; B21C 29/00

[52] U.S. Cl. ..... 72/253 A; 72/273; 72/342

[58] Field of Search ..... 72/253 A, 253 R, 255, 72/273, 272, 271, 342

[56] References Cited

U.S. PATENT DOCUMENTS 3,112,828 12/1963 Zipf ..... 72/253

3,919,873 11/1975 Biswas et al. ..... 72/257

FOREIGN PATENT DOCUMENTS 610796 3/1935 Fed. Rep. of Germany ..... 72/253

2008230 9/1971 Fed. Rep. of Germany ..... 72/253

1452385 10/1971 Fed. Rep. of Germany ..... 72/255

2202151 7/1972 Fed. Rep. of Germany ..... 72/253

435402 9/1935 United Kingdom ..... 72/253 A

*Primary Examiner*—Francis S. Husar

*Assistant Examiner*—D. M. Gurley

*Attorney, Agent, or Firm*—Holman & Stern

[57] ABSTRACT

In order to prevent heat loss by conduction from the billet and billet container in an indirect extrusion press, the sealing plate, which closes off one end of the billet container bore, is made in two parts which are spaced apart when an extrusion stroke is not taking place so that an air gap appears between the two parts to interrupt the path of heat conduction through the sealing plate to the rest of the extrusion press. The air gap may be produced in the pressure plate, between the sealing plate and the moving cross-head, instead of or in addition to the gap in the sealing plate.

6 Claims, 1 Drawing Figure

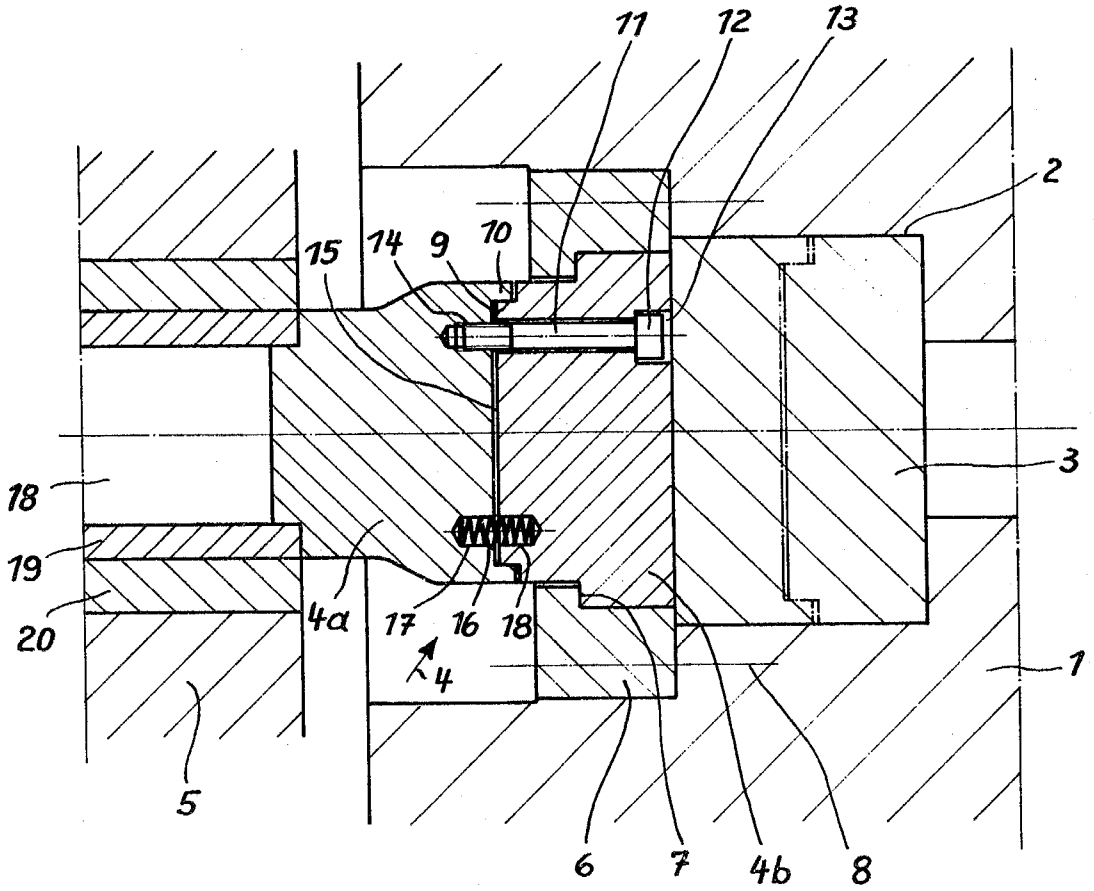
1
2
3
8
4b
7
6
13
12
11
70
9
14
15
18
16
17
4
4a
5
18
19
20

INDIRECT METAL EXTRUSION AND TUBE PRESS AND A SEALING PLATE AND A PRESSURE PLATE THEREFOR

The invention relates to an indirect metal extrusion and tube press, and to a sealing plate and a pressure plate therefor. In indirect extrusion, the sealing plate seals one end of the billet container, and the pressure plate is interposed between the sealing plate and the moving cross-head.

For known reasons, it is desirable for the temperature gradient along the length of the billet container to be kept as even as possible. This is very difficult to achieve. In particular, in indirect metal extrusion and pipe presses for extruding metals, part of the heat contained in the billet to be extruded flows into the sealing plate lying between the billet container and the moving cross-head, and is conducted into the parts of the press located behind the sealing plate which are cooler than the billet to be extruded. The end of the billet is therefore cooled.

In consequence, a sharp rise occurs in the force required at the end of the extrusion process. This also restricts the billet length that can be used. Further, for these reasons, the texture and consequently the hardness differ along the length of the extruded product, and this may have a detrimental effect on further processing of the product.

According to the invention, there is provided an indirect metal extrusion press having a sealing plate for sealing one end of a bore in a billet container, and a pressure plate attached to a moving cross-head which presses the pressure plate and the sealing plate against the billet container, the pressure and sealing plates forming a pressure transmission path which includes a pair of mutually adjacent surfaces lying in planes at right angles to the extrusion axis, said surfaces engaging with each other to prevent relative movement between them parallel to said planes but to permit relative movement along the axis of extrusion, compressible spacing members being provided between the surfaces to force them apart when pressure is not being transmitted along the path, to leave an air gap between the surfaces.

As a result of this arrangement, the appropriate parts of the sealing plate and/or pressure plate will be forced apart by the spacing members along the axis of extrusion at least during the non-pressing period. Because of the air gap now arising between the individual parts, direct outflow of heat from the front part of the sealing plate, which is in direct contact with the billet container and also with the billet, into the parts behind it is interrupted. Since the actual extrusion period, particularly with heavy metals, is substantially shorter than the periods between pressing, this arrangement prevents a large part of the heat contained in the billet and billet container from being conducted to the colder press parts.

In order to achieve yet further reduction in heat loss, the sealing plate and/or pressure plate may consist in each case of at least two parts. By dividing them into more than two parts, further air gaps and consequently further interruptions in the heat flow, are produced. It may, in fact, under certain circumstances suffice to divide up only the sealing plate and to leave the pressure plate in one piece. On the other hand, it is also possible to produce a desired quantity of individual parts interrupting the heat loss both in the sealing plate and in the pressure plate. Similarly, it is possible to design only the pressure plate in sections if this is considered adequate.

The spacing members may advantageously take the form of compression springs fitted in recesses in at least one of the parts of the sealing plate and/or pressure plate separated by an air gap. The strength and nature of the springs may be varied in accordance with the extrusion temperature.

The invention also provides a sealing plate and a pressure plate comprising first and second parts which have mutually adjacent surfaces lying in a plane at right angles to the axis of extrusion, said surfaces engaging with each other to prevent relative movement between them in a direction parallel to said plane but to allow relative movement along the extrusion axis, and compressible spacing members positioned between the parts to force them apart and leave an air gap between them when no pressure is exerted on the plate.

In order, however, to reduce the loss of heat even during the extrusion process itself, the part of the sealing plate lying against the billet container advantageously consists of a steel with poor heat-conducting properties and the part or parts of the sealing plate adjoining the moving cross-head consists of a steel with normal heat-conducting properties.

The invention will now be further described, by way of example, with reference to the accompanying drawing which shows a cross-section through part of an extrusion press in accordance with the invention.

A pressure plate 3 is fitted in a recess 2 in a moving cross-head 1 connected to the press piston of an indirect metal extrusion press, not shown in detail. A sealing plate 4 rests against this pressure plate 3, and consists of a front part **4*a* facing a billet container 5, and a rear part 4*b*. The plane of division lies at right angles to the extrusion axis. Part 4*b* is linked by means of a clamp ring 6, which rests on a ring base 7 in part 4*b*, to the moving cross-head 1 by means of screws 8 indicated by chain-dotted lines. The rear part 4*b* has a recess 9 in its side facing part 4*a*, and an annular shoulder 10 of the front part 4*a* engages in the recess, so that part 4*a* lies at right angles to the extrusion axis in order to avoid relative displacement of parts 4*a* and 4*b***.

Limited axial displacement of both parts **4*a* and 4*b* is permitted by bolts 11 which loosely connect the two parts. Heads 12 of the bolts 11 lie in rear-facing recesses 13 in part 4*b*, the recesses 13 being deeper than the height of the heads 12**.

Between parts **4*a* and 4*b* there is an air gap 15 at the ends of the bolts 11 which are fastened to part 4*a* of the sealing plate 4 by a screw thread 14. The width of the air gap is equal to or less than the difference between the depth of the recesses 13 and the height of the heads 12 of the bolts 11**.

Compression springs 16 are fitted between the parts and are held in recesses 17 in part **4*a* and 18 in part 4*b*, in order to force parts 4*a* and 4*b* apart to form the air gap 15**, when there is no pressure on the sealing plate.

The face of the front part **4*a* of the sealing plate 4 lies against and seals off the bore 18 and the inner bushing 19 of the billet container 5. A sleeve 20 surrounds the bushing 19**.

Parts **4*a* and 4*b* of the sealing plate 4 may consist of steels of different heat-conductivity in order to avoid heat outflow during the pressing process. For example, front part 4*a* may be built of austenite steel with poor heat-conductivity and the rear part 4*b*** of a tool steel of normal heat-conductivity.

The pressure plate 3 may additionally be constructed in two parts in a similar manner. This is shown in dotted lines in the drawing.

We claim:

1. An indirect metal extrusion press having a sealing plate for sealing one end of a bore in a billet container, a moving cross-head, and a pressure plate attached to the moving cross-head, the moving cross-head pressing the pressure plate against the sealing plate and the sealing plate against the billet container, the pressure and sealing plates forming a pressure transmission path which includes a pair of mutually adjacent surfaces lying in parallel planes at right angles to the extrusion axis, said surfaces engaging with each other to prevent relative movement between them parallel to said planes but to permit relative movement along the axis of extrusion, compressible spacing members being provided between the surfaces to force them apart when pressure is not being transmitted along the path, to leave an air gap between the surfaces.

2. A press as claimed in claim 1, wherein the sealing plate is formed in two parts, and said mutually adjacent surfaces being provided on facing surfaces of the said parts.

3. A press as claimed in claim 1, wherein the pressure plate is formed in two parts, and said mutually adjacent surfaces are provided on facing surfaces of the said parts.

4. A press as claimed in claim 1, wherein both the sealing plate and the pressure plate are formed in two parts, and pairs of said mutually adjacent surfaces are provided on the facing surfaces of the parts of each plate.

5. A press as claimed in any preceding claim, wherein the compressible spacing members are compression springs received in recesses in at least one of the or each pair or mutually adjacent surfaces.

6. A press as claimed in claim 2, wherein that part of the sealing plate adjoining the billet container is made of a steel which is a poor conductor of heat, and the other part of the sealing plate is of a steel which is a better conductor of heat.

* * * * *